US006123713A

United States Patent [19]

Yiu et al.

[11] Patent Number: 6,123,713

[45] Date of Patent: Sep. 26, 2000

[54] HAIR REMOVAL DEVICE WITH VIBRATING ASSEMBLY

[75] Inventors: Wai-Wah Yiu, Kowloon, The Hong Kong Special Administrative Region of the People's Republic of China; Zeev Golan, Herzlia, Israel

[73] Assignee: K.I.S. LTD, Kowloon, The Hong Kong Special Administrative Region of the People's Republic of China

[21] Appl. No.: 09/246,454

[22] Filed: Feb. 9, 1999

Related U.S. Application Data

[63] Continuation-in-part of application No. 09/112,971, Jul. 9, 1998.

[51] Int. Cl.[7] ..... A61B 17/50

[52] U.S. Cl. ..... 606/133; 606/132; 425/71

[58] Field of Search ..... 606/133, 131, 606/132, 134, 9–18; 425/71–102

[56] References Cited

U.S. PATENT DOCUMENTS

| | | | |
|---|---|---|---|
| 853,096 | 5/1907 | Lewis . | |
| 1,071,978 | 9/1913 | White . | |
| 2,417,530 | 3/1947 | Weiser . | |
| 2,888,927 | 6/1959 | Fozard . | |
| 2,894,512 | 7/1959 | Tapper . | |
| 3,054,405 | 9/1962 | Tapper . | |
| 3,088,470 | 5/1963 | Hall . | |
| 4,174,713 | 11/1979 | Mehl . | |
| 4,274,413 | 6/1981 | Hahn et al. . | |
| 5,057,116 | 10/1991 | Zucker . | |
| 5,100,414 | 3/1992 | Dolev . | |
| 5,163,288 | 11/1992 | Doley . | |
| 5,226,907 | 7/1993 | Tankovich . | |
| 5,230,303 | 7/1993 | Rubino . | |
| 5,281,233 | 1/1994 | Dolev . | |
| 5,419,344 | 5/1995 | DeWitt . | |
| 5,425,728 | 6/1995 | Tankovich . | |
| 5,507,753 | 4/1996 | Iwasaki et al. | 606/133 |
| 5,595,568 | 1/1997 | Anderson et al. . | |
| 5,630,811 | 5/1997 | Miller . | |

*Primary Examiner*—Michael Buiz
*Assistant Examiner*—Lien Ngo
*Attorney, Agent, or Firm*—Pennie & Edmonds LLP

[57] ABSTRACT

A device for removing unwanted hair, including a hair-plucking assembly and a vibrating assembly adjacent the hair-plucking assembly, wherein the device removes hair by uprooting it while vibrating the skin to minimize discomfort.

17 Claims, 8 Drawing Sheets

HAIR REMOVAL DEVICE WITH VIBRATING ASSEMBLY

This is a continuation-in-part of application Ser. No. 09/112,971, filed Jul. 9, 1998.

FIELD OF THE INVENTION

The present invention relates generally to a depilatory device for removal of unwanted hair by trapping and uprooting the hair, and more specifically, to a device for removing unwanted hair having a vibrating assembly or system to massage the user's skin and to minimize pain while removing hair.

BACKGROUND OF THE INVENTION

There exists a need for the removal of unwanted hair to maintain a desirable physical appearance. There are many different devices known in the art that are useful for removing unwanted hair, such as razors, tweezers, and other depilatory devices.

Although razors provide quick and easy hair removal, hair remains visible at the surface of the skin and quickly regrows. Therefore one must shave frequently in order to maintain smooth skin and a desired appearance. Tweezers also may be used. Prior art tweezers comprise two arms that are resiliently biased away from each other, each arm having an opposing surface. The hair is positioned between the two opposing surfaces, and the arms are pressed together, thereby grasping the hair between the two opposing surfaces of the tweezer arms. The hair is then plucked from the body. Tweezers provide longer-lasting hair removal. However, removing hair with tweezers is a tedious process since traditional tweezers can remove only one hair at a time. In addition, precise handling is required in order to position and grasp the hair between the two, usually small, opposing surfaces.

In processes involving the uprooting of hair, care must be taken so that the hair is not inadvertently cut. In addition, it is desirable to pull out as many hairs as quickly as possible and as painlessly as possible.

Various devices are known in the art for hair removal, such as is described in U.S. Pat. No. 5,281,233 to Dolev ("Dolev patent"). The Dolev hair removal device generally comprises a housing and a hair-plucking assembly rotatably mounted to the housing. The hair plucking assembly includes at least one disc assembly comprising (i) a pair of complementary discs, each of the discs having at least three radially extending arms terminating in flattened peripheral portions which, when pressed against the corresponding portion of the arms of the other disc forms a trap for the hair; and (ii) a hub for accommodating and rotating the pair of discs so that the flattened peripheral portions of the discs are alternately brought together to form a trap and apart to eject the removed hair.

There is a need, however, for a depilatory device, which is as easy and inexpensive to assemble and maintain as prior art devices, but has an even larger trap area for grasping unwanted hair so that a greater number of hairs may be uprooted than is currently possible. There is also a need for a depilatory device that minimizes the pain associated with uprooting hair.

SUMMARY OF THE INVENTION

The present invention relates to a depilatory device for efficient removal of unwanted hair by uprooting the hair, said device generally comprising a housing and a hair-plucking assembly rotatably mounted to the housing, wherein the hair-plucking assembly comprises at least one disc assembly having six hair traps.

More specifically, the at least one disc assembly comprises (i) three complementary discs, including two outer discs and an internal disc, each of the discs having at least three radially extending arms terminating in flattened peripheral portions, wherein pressing the flattened peripheral portions of the two outer discs against the corresponding portion of the internal disc forms two traps for unwanted hair; and (ii) a hub for accommodating and rotating the three discs so that the flattened peripheral portions of the two outer discs are alternately brought together to form a trap and apart to eject the removed hair.

The present invention also relates to a depilatory device having a vibrating mechanism to alleviate the pain of hair removal by uprooting.

BRIEF DESCRIPTION OF THE DRAWINGS

Reference is next made to a brief description of the drawings, which are intended to illustrate the hair removal device according to the present invention. The drawings and detailed descriptions which follow are intended to be merely illustrative, and are not intended to limit the scope of the invention as set forth in the appended claims.

DETAILED DESCRIPTION OF THE HAIR REMOVAL DEVICE

The present invention is a hair removal device having at least one disc assembly comprising three discs, including two outer discs and an internal disc, which provides for a greater hair-grasping area than prior art disc assembly hair removers.

Figure 1:
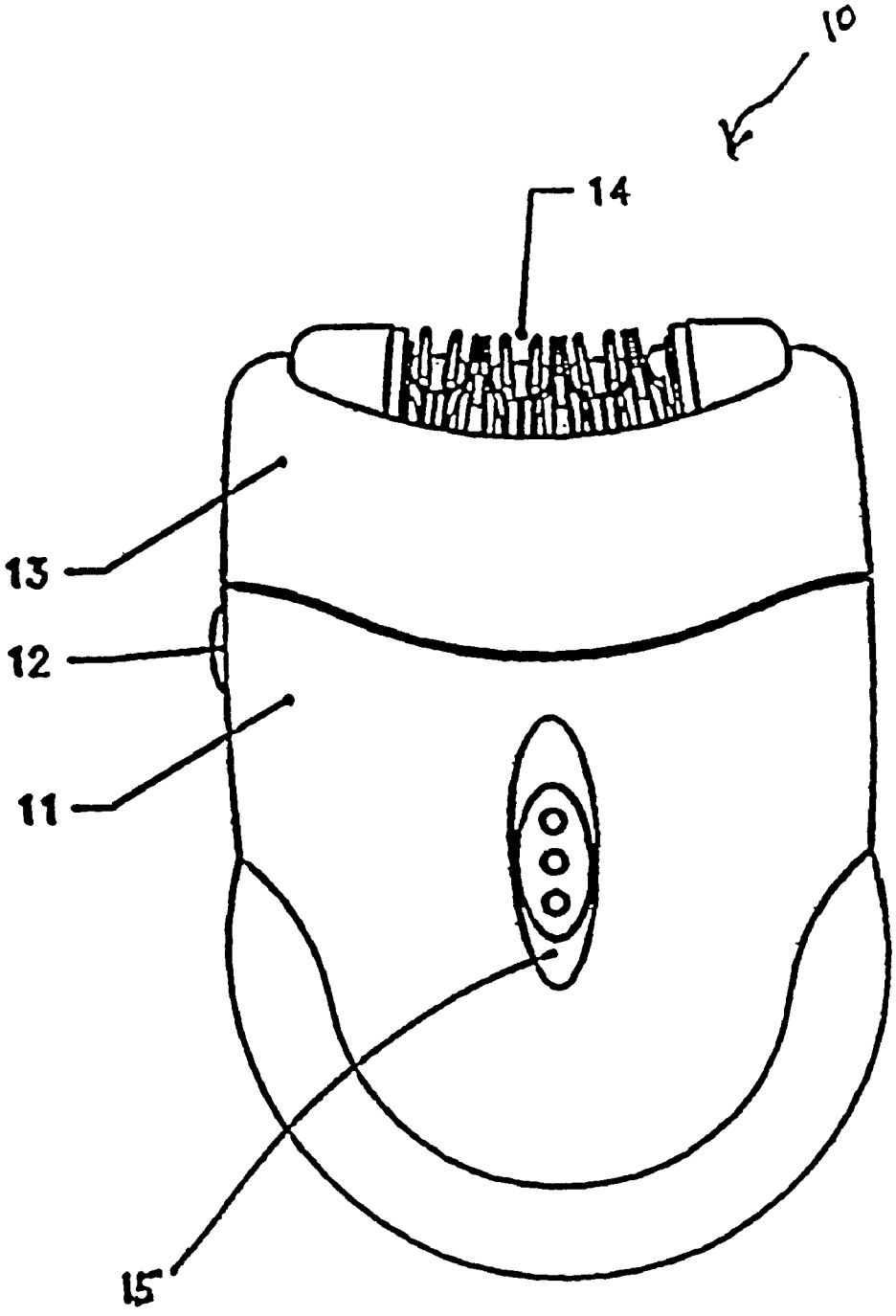
FIG. 1 is a front view of a hair removal device according to the present invention.

Referring to the drawings, FIG. 1 illustrates a preferred embodiment of a hair removal device 10 according to the present invention. Hair removal device 10 comprises housing 11, housing cap 13, and hair-plucking assembly 14. Housing 11 is ergonomically shaped to facilitate easy and comfortable gripping by one hand and is preferably constructed of plastic although alternative materials may also be used. In addition, the orientation of housing 11 in relation to hair-plucking assembly 14 may be varied in any number of alternative configurations to optimize efficiency and convenience of use. Examples of suitable alternative configurations are described in the Dolev patent, incorporated herein by reference in its entirety. Hair-plucking assembly 14 partially extends through an opening in housing cap 13, and can be removed, for cleaning or maintenance, by pressing release button 12.

Figure 2:
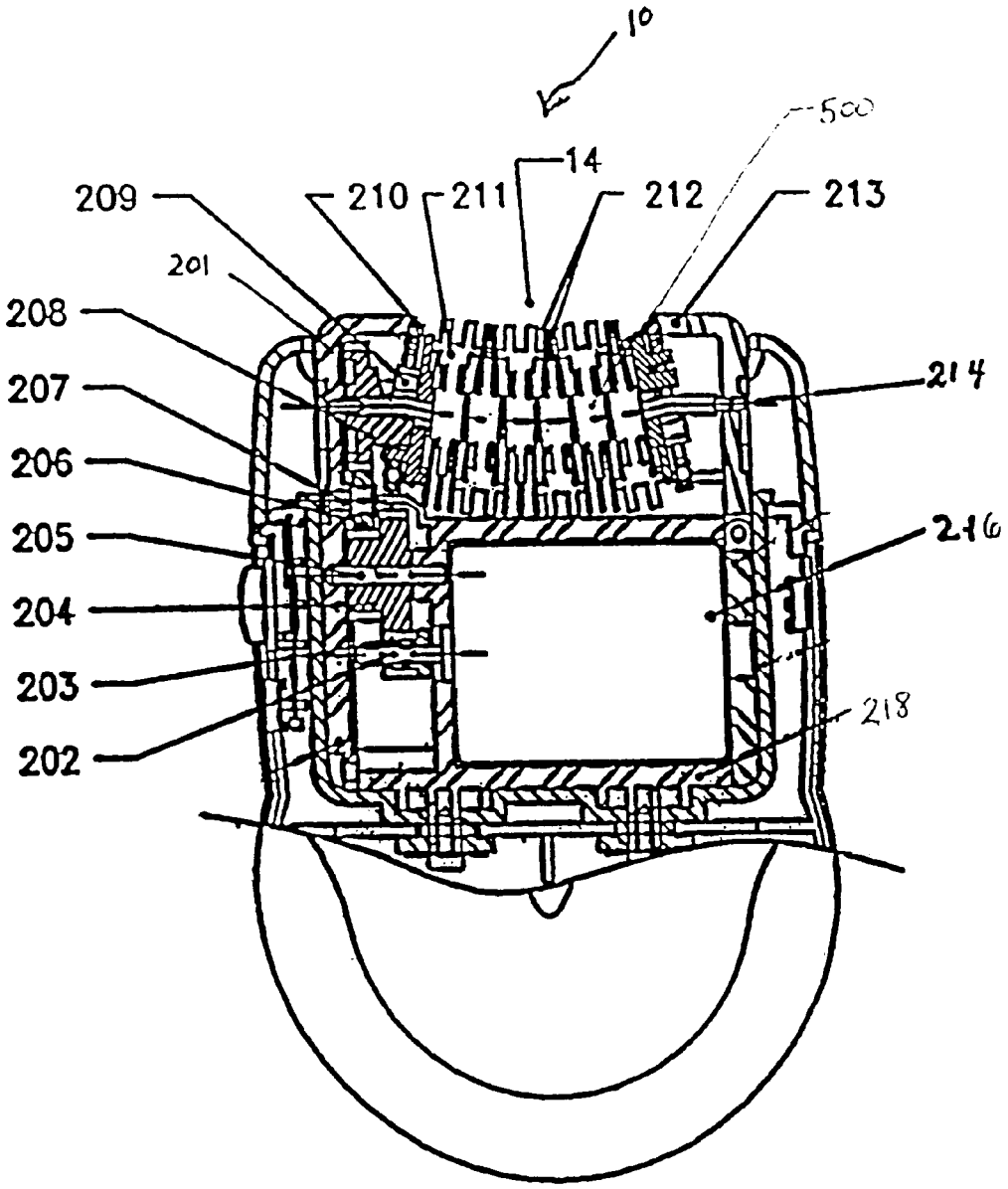
FIG. 2 is a front cross-sectional view of the hair removal device including a plurality of disc assemblies.

As shown in FIG. 2, motor 216 is contained within housing 11 and may be any of a wide variety of miniature motors. Motor 216 may be operated by any convenient and available power source, including house current or a battery (not shown). Hair-plucking assembly 14 is powered by motor 216, which is activated by on/off switch 15.

In the hair removal device illustrated in FIG. 2, motor housing 218 contains both motor 216 and a reduction gear system, which converts the rotational speed produced by motor 216 to the proper rotational speed of hair-plucking assembly 14. Any suitable reduction gear system may be used. In detail, motor shaft 202 is connected to motor shaft gear 203 which meshes with a larger reduction gear 204 mounted on reduction gear shaft 205. The rotational speed of reduction gear 204 is then transmitted to drive gear 208 of hair-plucking assembly 14 by transmission gear 206 mounted on transmission gear shaft 207. As known in the art, each gear may either be connected to or integrally formed with its corresponding shaft. In addition, any system that provides adequate rotational motion to hair-plucking assembly 14 may be incorporated into the hair removal device of the present invention.

Hair-plucking assembly 14 is made up of at least one disc assembly 500. As shown in FIG. 2, the preferred embodiment includes six disc assemblies 500, and all disc assemblies 500 are identical. Each disc assembly 500 is symmetric with respect to clockwise or counterclockwise rotation. Adjacent disc assemblies 500 are engaged to each other by engagement means comprising engagement protrusions 303 and engagement recessions 304 (shown in FIG. 4) along curved shaft 214. These engagement protrusions 303 and recessions 304 ensure that adjacent disc assemblies 500 are angularly offset from one another by appropriate angles and also ensures that adjacent disc assemblies 500 interact properly to form effective hair traps. Curved shaft 214 may be made of any appropriate material, including various rigid or flexible materials. Appropriate support must be provided for a curved shaft made of a flexible material.

In addition, orientation of hair-plucking assembly 14 is separately controlled by left bracket 201 and right bracket 213. Furthermore, two sets of bearings 210 are placed at the end of hair-plucking assembly 14 to provide smooth and steady rotation while the rotational speed is transmitted from the drive gear 208 to bearing support 209.

Figure 3:
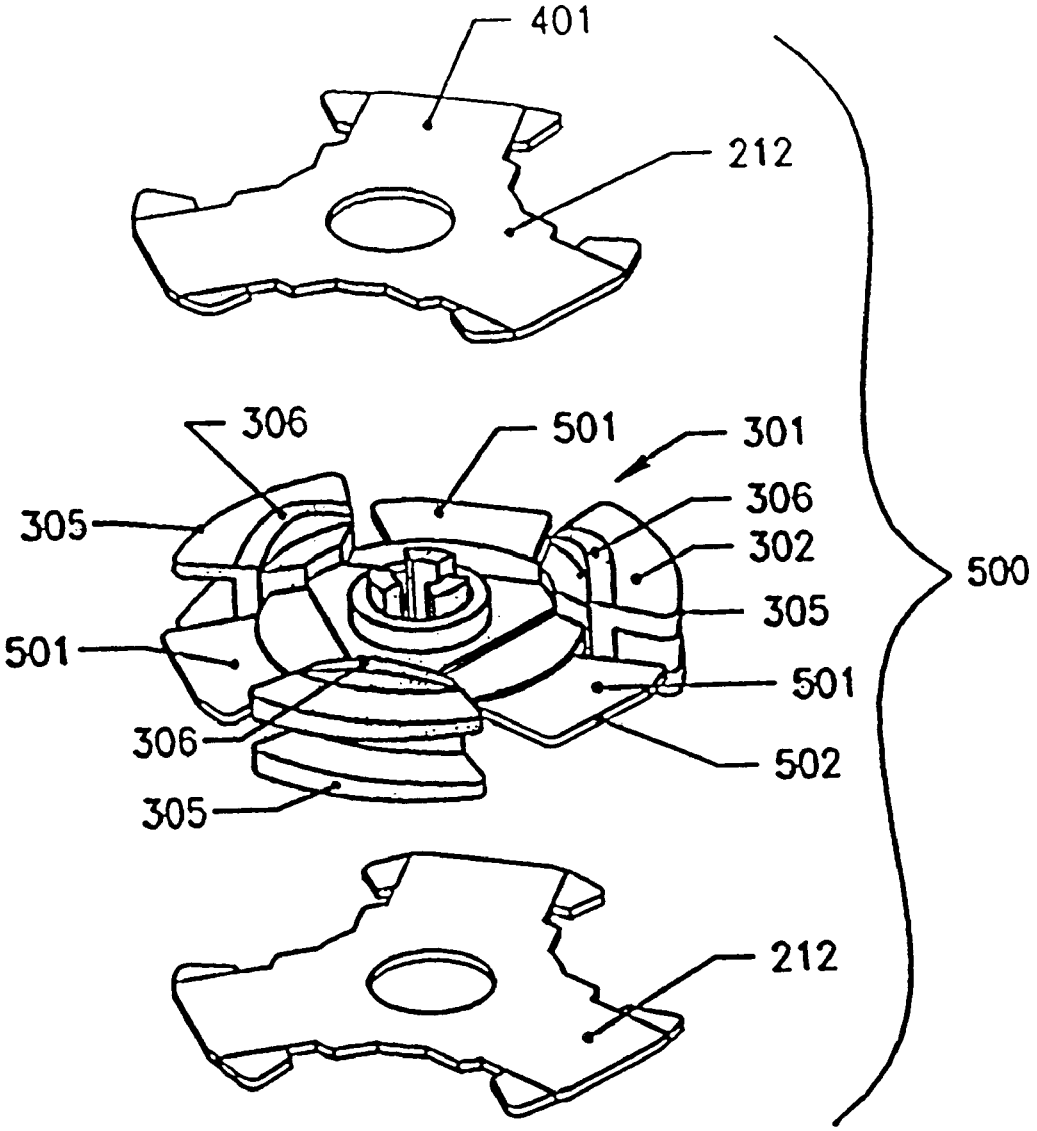
FIG. 3 is an exploded perspective view of a disc assembly including the two outer discs and the internal disc.

As shown in FIG. 3, disc assembly 500 comprises three main elements, including an internal disc assembly 301, and a pair of outer discs 212. Each internal disc assembly 301 comprises disc carrier 302 and insert disc 501. Preferably, disc carrier 302 is made of a plastic material such as Acetal plastic and insert disc 501 and outer discs 212 are made of stainless steel. In other words, the portions of disc assembly 500, intended for contact with the hair are made of a metal material, which is particularly effective for plucking hair, and the portions of disc assembly 500, which contact curved shaft 214, are made of plastic to facilitate smooth rotation of the disc assembly 500. Alternatively, these components may be made by other appropriate materials known in the art.

Figure 4:
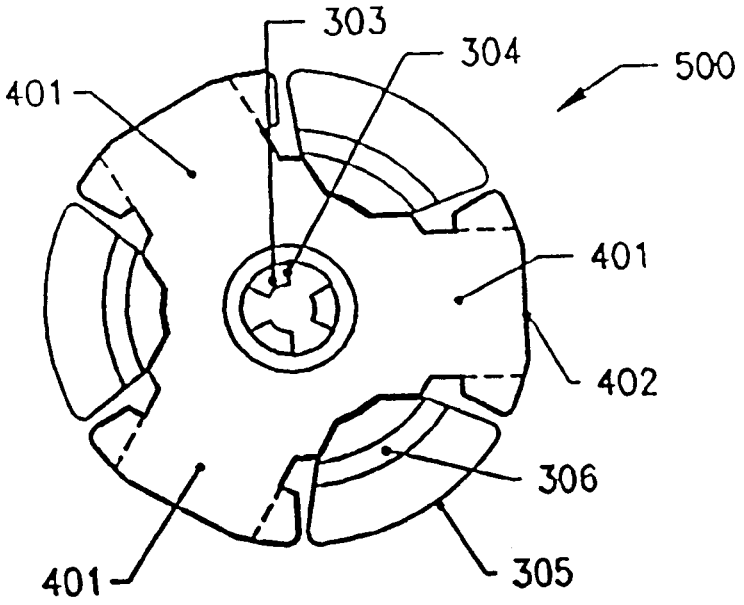
FIG. 4 is a plan view of the disc assembly of FIG. 3.
Figure 5:
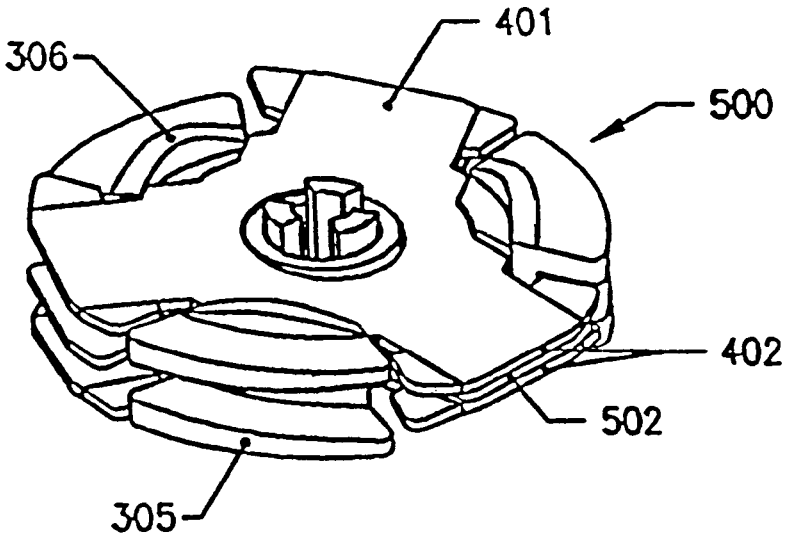
FIG. 5 is a perspective view of the disc assembly of FIG. 3.

As shown in FIGS. 3, 4, and 5, each insert disc 501 and all outer discs 212 include three radially extending arms 401 oriented approximately 120° apart. Each arm 401 terminates in flattened peripheral portion 402. Flattened peripheral portions 402 are constructed such that when the flattened peripheral portions 402 of the pair of outer discs 212 of each disc assembly 500 are pressed against the corresponding flattened peripheral portion 502 of insert disc 501, two traps are formed, which tend to grasp and hold any hair, by the peripheral portions 502 and 402 as shown in FIG. 5. In other words, two traps are formed to grasp hair when a pair of opposing clamping forces are applied to flattened peripheral portions 401 of outer discs 212. Therefore, six traps may be activated for a 360° rotation of disc assembly 500.

As illustrated in FIG. 2, hair removal device 10 includes six sets of disc assemblies 500. Each disc assembly 500 is mounted adjacently to at least one other disc assembly 500 on curved shaft 214, and all six sets of disc assemblies 500 are bounded by left bracket 201 and right bracket 213. In addition, the upper dimension between left bracket 201 and right bracket 213 are designed such that disc assemblies 500 may properly rotate in an inclined angle as shown in FIG. 2, thereby forming effective hair traps.

The central portion of each outer disc 212 includes a generally circular opening, which is sized and shaped so that each outer disc 212 may be mounted on internal disc assembly 301. The configuration, i.e., dimensions and tolerances, of all components 212, 301 of each disc assembly 500 is designed such that these components fit snugly together and remain engaged during operation of the device 10.

In alternative embodiments of hair removal device 10, disc assembly 500 may comprise one or two integral pieces having between them all the elements of the three components 212, 301 discussed above. The materials must be chosen so as to enable such an alternative embodiment to form effective hair grasping traps.

Disc carrier 302 of internal disc assembly 301 comprises three U-shaped members 305, which extend to approximately the same radial distance as radially extending arms 401. Rotational motion is imparted either clockwise or counterclockwise to outer discs 212 by these U-shaped members 305. Extending from each of the two arms of each U-shaped member 305 is a pincher 306. In other words, each U-shaped member 305 has a pair of opposing pinchers 306. Pinchers 306 extend beyond the plane of radially extending arms 401 such that as disc assembly 500 rotates, pinchers 306 come into contact with and thereby imparts clamping forces to the radially extending arm 401 of adjacent disc assemblies 500, which causes adjacent disc assemblies 500 to form traps. Disc assemblies 500 are configured and assembled within the device such that pinchers 306 of each disc assembly 500 remain adjacent to radially extending arms 401 of adjacent disc assemblies 500 during rotation of all disc assemblies 500.

All clamping forces are applied to flattened peripheral portions 402 of the outer discs 212. Hence, the traps formed between the pair outer discs 212 and internal disc assembly 301 of each disc assembly 500 serve to grasp hair and remove it by means of the power provided by motor 216.

Figure 6:
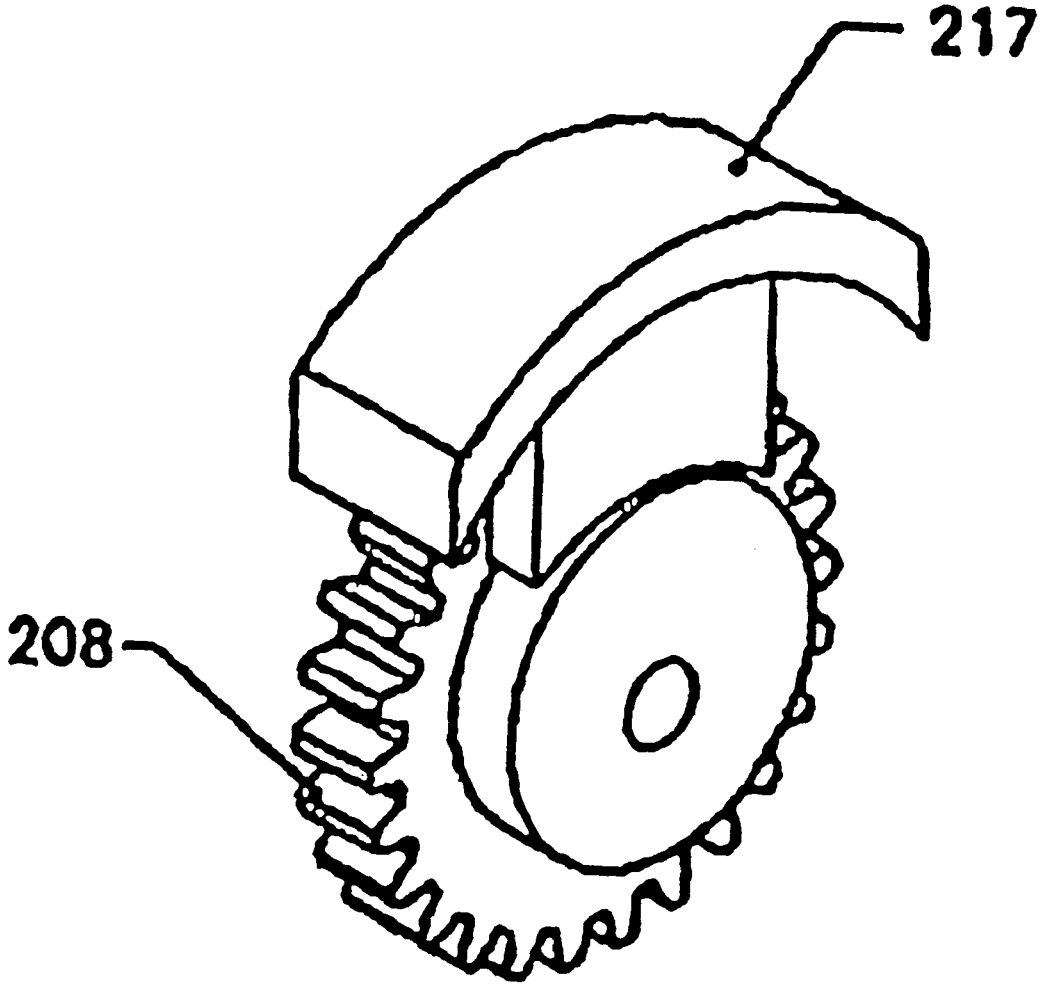
FIG. 6 is a perspective view of a vibrating system.
Figure 9:
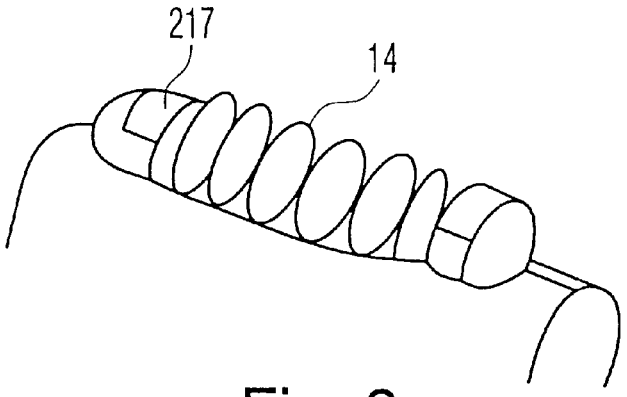
FIG. 9 is a perspective view of the hair removal device showing the hair-plucking assembly and the vibrating assembly.
Figure 10:
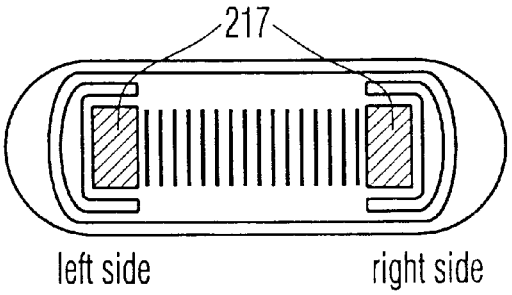
FIG. 10 is a top view of the hair removal device with the vibrating assembly.
Figure 11:
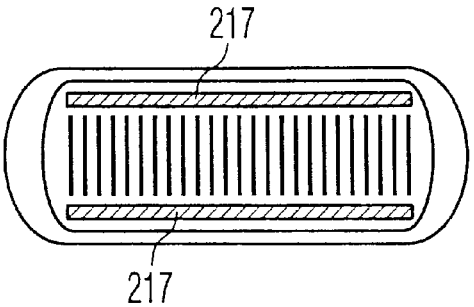
FIG. 11 is a top view of an alternative embodiment of the hair removal device with the vibrating assembly.

In the hair removal device illustrated in FIG. 1, a vibrating assembly or system, as shown in FIG. 6, may be added to the device in order to massage the user's skin and to minimize pain while removing hair. The vibrating system comprises a vibrating head 217 slideably mounted to drive gear 208. Vibrating head 217 is made of any material known in the art will effectively impart the vibratory stimulation to the user's skin. Appropriate soft materials include thermoplastic elastomers or rubber materials, and appropriate hard materials include ABS, polycarbonate, acetal, or other appropriate materials known in the art. The vibrating assembly may alternatively comprise a pair of vibrating heads as shown in FIGS. 9–11. As shown in FIGS. 9 and 10, vibrating heads 217 are located near or approximately adjacent to hair-plucking assembly 14 for transmission of vibrations to the hair removal area. Each vibrating head 217 is no more than approximately 5 to 6 mm from hair-plucking assembly 14. In FIGS. 9 and 10, vibrating heads 217 are located at both ends of hair-plucking assembly 14. Alternatively, vibrating heads 217 may be located along the top and bottom sides of hair-plucking assembly 14 as shown in FIG. 11. Each vibrating head 217 has a rounded or contoured top so that the device 10 may be moved smoothly across the skin in any direction and at any angle.

Figure 7:
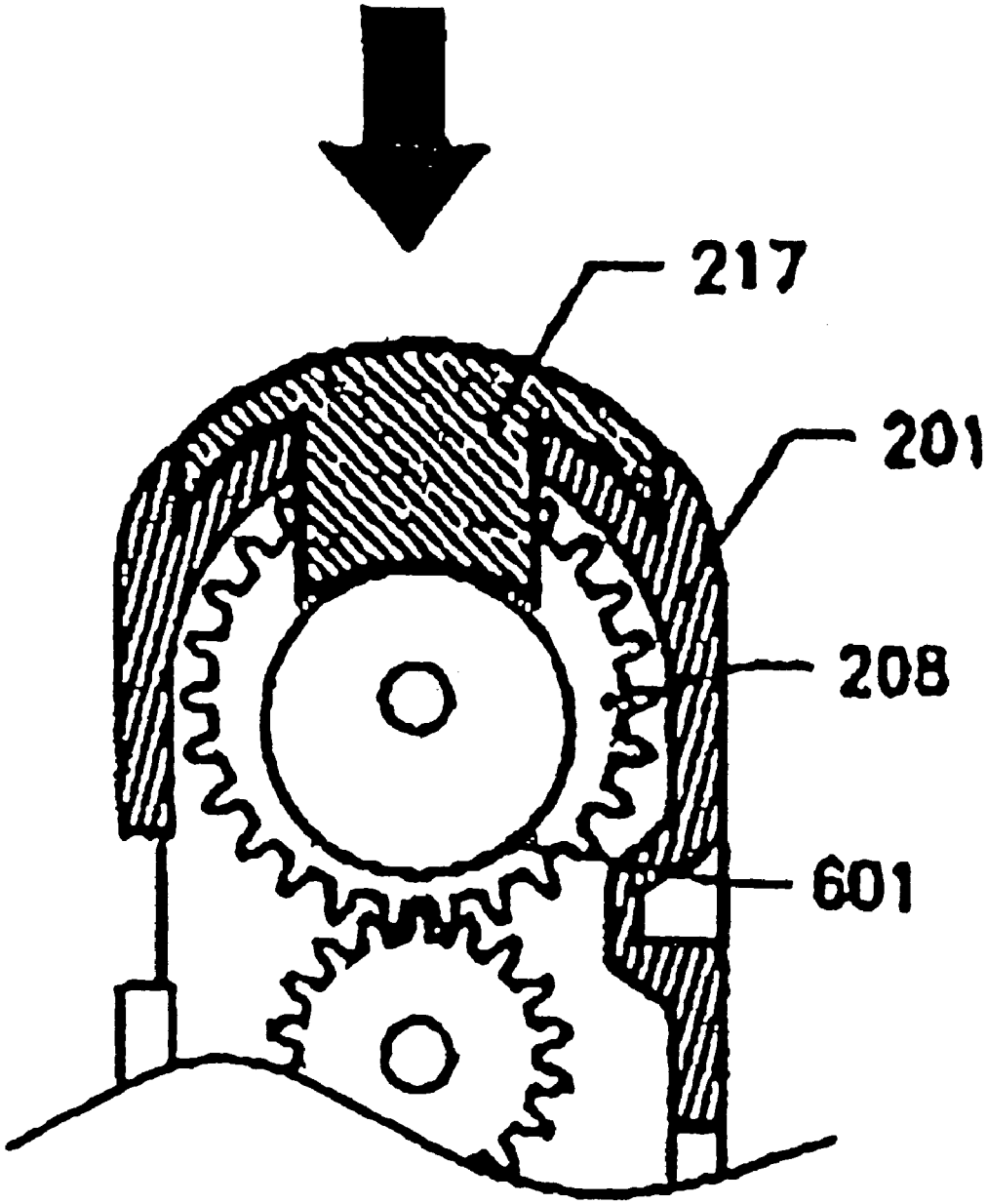
FIGS. 7 and 8 illustrate the function of the vibrating system of FIG. 6.
Figure 8:
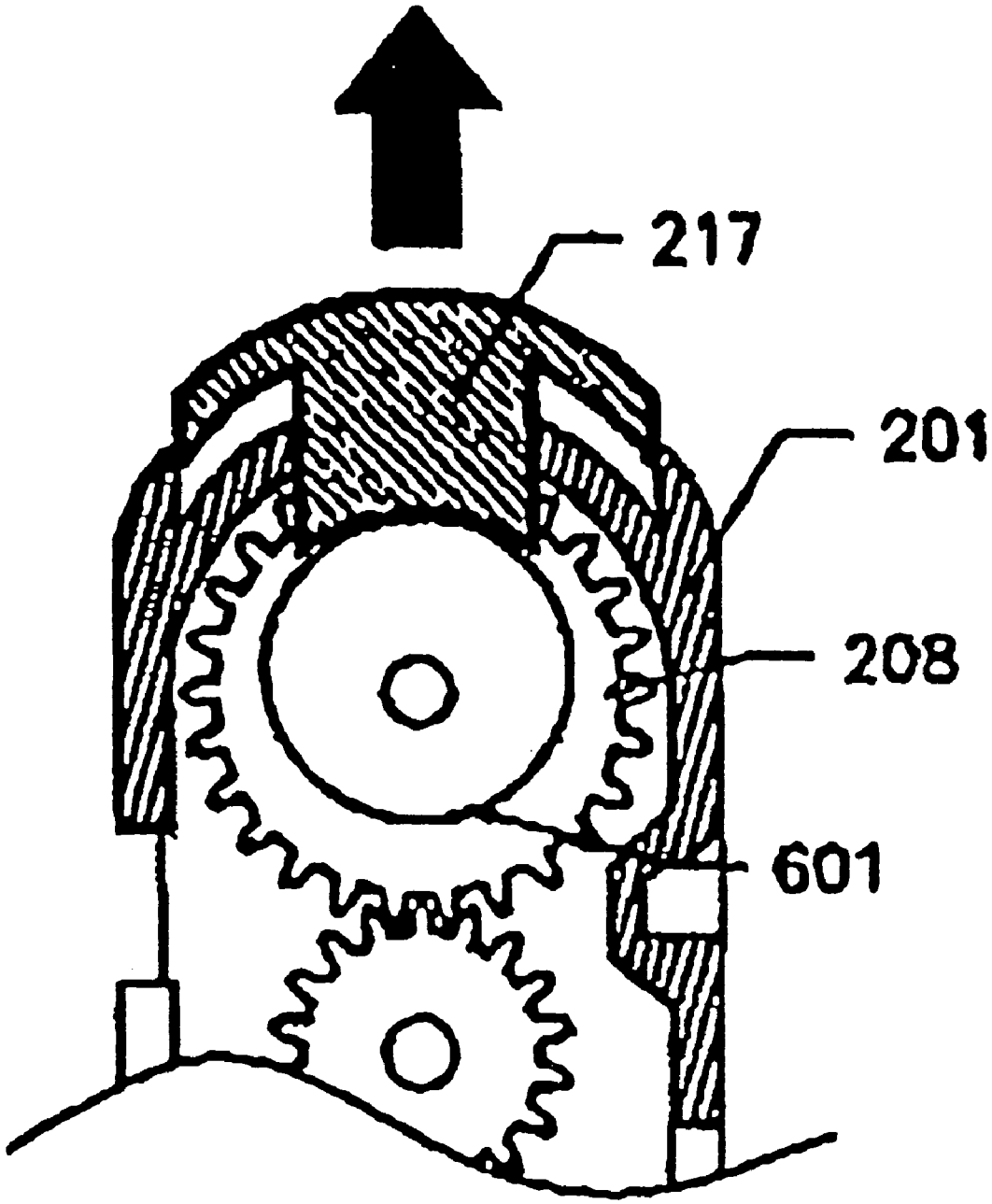

As shown in FIGS. 6–8, an eccentric cylinder 601 is mounted to drive gear 208. Eccentric cylinder 601 has an axis of rotation that is offset from its geometric center such that rotation of drive gear 208 lifts and lowers vibrating head 217 relative to the axis of rotation. This principle is illustrated in FIGS. 7 and 8. In FIG. 7, vibrating head 217 has been driven into a low position by the rotation of the drive gear 208. After the drive gear 208 has rotated 180°, the vibrating head 217 is driven into a high position as shown in FIG. 8. Therefore, as drive gear 208 rotates, vibrating head 217 moves continuously from the low to the high position and back again to the low position, etc. Vibrating head 217 is also bounded laterally by left bracket 201 or right bracket 213.

The vibrating assembly serves to massage or impart vibrations to the user's skin as device 10 is operated, thereby minimizing any discomfort associated with the hair removal process. This vibrating system may also be incorporated into any type of hair removal device, including tweezers and the hair removal device embodied in the Dolev patent, that removes hair by uprooting the hair to provide this massaging effect. In addition, the vibration assembly may be provided with an adjustable speed control in a manner known in the art.

In the preferred embodiment, the vibrating system is powered by the same motor 216 that powers the hair-plucking assembly 14 and shares drive gear 208. Although this design provides for a convenient and compact design, it is not required. The vibrating assembly may be powered independently of the hair-plucking assembly in alternative embodiments, such as by house currents or batteries. In such an embodiment, the vibration speed may be adjusted independently of the speed at which the hair-plucking assembly operates.

The present invention may be embodied in other forms without departing from its spirit or essential characteristics. The described embodiments are to be considered only as illustrative and not as restrictive. For example, each disc assembly 500 does not necessarily require three sets of radially extending arms 401. More arms may be incorporated into the design of the present invention, thereby providing more traps per disc assembly rotation. Additional means also may be incorporated into the design to prolong the time during which the traps are formed as described in the Dolev patent. The scope of the invention is, therefore, indicated by the appended claims.

What is claimed:

1. A hair removal device comprising:

a hair-plucking assembly including at least two arms, wherein one arm may be pressed against the other arm to form a trap for hair; and a vibrating assembly attached to said hair-plucking assembly and including a vibrating head coupled to a drive gear such that rotation of the drive gear drives said vibrating head.

2. The hair removal device of claim 1, wherein said rotating drive gear linearly drives said vibrating head from a high position to a low position, and from a low position to a high position.

3. The hair removal device of claim 2, wherein said vibrating assembly further comprises an eccentric cylinder fixedly mounted to said drive gear and having a geometric center offset from the center of rotation of said drive gear, wherein said vibrating head is slidably coupled to said eccentric cylinder.

4. The hair removal device of claim 1, wherein said vibrating assembly is adjacent to said hair-plucking assembly.

5. The hair removal device of claim 1, wherein the speed at which said vibrating head is being driven is constant.

6. The hair removal device of claim 1, wherein the speed at which said vibrating head is being driven is adjustable.

7. A hair removal device comprising:

a rotatable hair-plucking assembly comprising at least two arms, wherein one arm may be pressed against the other arm to form at least one trap for hair as said hair-plucking assembly is rotated a power system comprising a motor and a drive gear, said power system being operatively coupled to said hair-plucking assembly for rotating said hair-plucking assembly; and a vibrating assembly comprising a first vibrating head coupled to said drive gear of said power system such that rotation of said drive gear drives said first vibrating head.

8. The hair removal device of claim 7, wherein said first vibrating head of said vibrating assembly is adjacent to said hair-plucking assembly such that it may vibrate a user's skin near the hair-removal site.

9. The hair removal device of claim 8, further comprising a housing to which said hair-plucking assembly is rotatably mounted and a left bracket and right bracket mounted to said housing for orienting said hair-plucking assembly as it rotates to form said at least one hair trap.

10. The hair removal device of claim 9, wherein one of said left and right brackets orients said vibrating head.

11. The hair removal device of claim 8, wherein said first vibrating head of said vibrating assembly is no more than approximately 6 mm from said hair-plucking assembly.

12. The hair removal device of claim 8, wherein said first vibrating head comprises a rounded top so that said hair removal device may be moved smoothly across the skin in any direction and at any angle.

13. The hair removal device of claim 8, wherein said vibrating assembly comprises a second vibrating head coupled to said drive gear of said power system such that rotation of said drive gear drives said second vibrating head.

14. The hair removal device of claim 13, wherein said second vibrating head of said vibrating assembly is adjacent to said hair-plucking assembly, opposite said first vibrating head such that it may vibrate a user's skin near the hair-removal site.

15. A hair removal device comprising:

(A) a housing;

(B) a hair-plucking assembly rotatably mounted to a curved shaft mounted in the housing, wherein said hair-plucking assembly includes six identical disc assemblies, each of which comprise:

(i) an internal disc assembly comprising an insert disc, having three arms, mounted on a disc carrier;

(ii) a pair of outer discs mounted on said internal disc assembly, having three pairs of arms, each of which may be alternately pressed against the three arms of said internal disc to form six traps for hair, wherein said disc carrier comprises:

(a) three U-shaped members for engaging said three pairs of arms of said pair of outer discs so as to impart rotational motion to said pair of outer discs upon rotation of said internal disc assembly about an axis of said internal disc assembly;

(b) three pairs of pinchers which extend axially from each of said three U-shaped members beyond the plane of said arms of each pair of said outer discs for imparting a clamping force on at least one adjacent disc carrier; and (c) engagement means for engaging at least said one adjacent disc carrier so that rotational movement of said one disc carrier imparts rotational motion to at least said one adjacent disc carrier;

(C) a power system for rotating said hair-plucking assembly, comprising a motor and a drive gear; and (D) a vibrating assembly comprising a vibrating head mounted to said drive gear such that rotation of said drive gear effects linear movement of said vibrating head.

16. The hair removal device of claim 1, wherein said drive gear drives said vibrating head in a linear movement.

17. The hair removal device of claim 7, wherein said drive gear drives said vibrating head in a linear movement.

* * * * *